US005079960A

United States Patent [19]

Kauer et al.

[11] Patent Number: 5,079,960

[45] Date of Patent: Jan. 14, 1992

[54] TEST SUPPORT

[75] Inventors: Harald Kauer; Karl-Heinz Wiemer, both of Ettlingen, Fed. Rep. of Germany

[73] Assignee: IBP Pietzsch GmbH, Fed. Rep. of Germany

[21] Appl. No.: 564,533

[22] Filed: Jul. 30, 1990

[30] Foreign Application Priority Data

Aug. 2, 1989 [DE] Fed. Rep. of Germany ..... 3925616

[51] Int. Cl.[5] ..... G01M 19/00; F16M 11/08

[52] U.S. Cl. ..... 73/865.9; 73/167; 248/542

[58] Field of Search ..... 73/865.9, 167, 11; 248/542, 515

[56] References Cited

U.S. PATENT DOCUMENTS

| | | | |
|---|---|---|---|
| 2,446,566 | 8/1948 | Wenk, Jr. | 73/167 |
| 2,701,963 | 2/1955 | Balleisen et al. | 73/167 |
| 2,891,398 | 6/1959 | Hughes | 73/167 X |
| 3,751,973 | 8/1973 | Strauss et al. | 73/45 |
| 3,761,806 | 9/1973 | Napor et al. | 324/658 |
| 4,163,142 | 7/1979 | Descovich et al. | 219/91.1 X |
| 4,353,446 | 10/1982 | Wilken et al. | 192/84 C X |
| 4,523,487 | 6/1985 | Pietzch et al. | 74/644 X |
| 4,589,273 | 5/1986 | Tamasi et al. | 73/11 |
| 4,667,506 | 5/1987 | Jenkins et al. | 73/45.2 |
| 4,732,036 | 3/1988 | Weeder | 73/118.1 |
| 4,843,895 | 7/1989 | Harper et al. | 73/865.9 |

FOREIGN PATENT DOCUMENTS

| | | | |
|---|---|---|---|
| 2297461 | 8/1976 | France | 73/865.8 |

*Primary Examiner*—Tom Noland
*Attorney, Agent, or Firm*—Rogers & Killeen

[57] ABSTRACT

A test support including an undercarriage and an opening formed therein which is dimensioned for a turret or the like comprises a combat space container interchangeably accommodated in said opening. The combat space container comprises a cage which is detachably joined to said undercarriage, and a roof which is detachably joined to the cage. The cage carries largely invariant components and/or equipment, while the roof carries components and/or equipment which is to be varied more frequently.

8 Claims, 2 Drawing Sheets

TEST SUPPORT

BACKGROUND OF THE INVENTION

The present invention is directed to a test support comprising an undercarriage and an opening formed in the undercarriage and dimensioned for a turret or the like, said test support adapted to be interchangeably accommodated in an opening formed in the undercarriage of a combat vehicle and dimensioned for a turret or the like. When designing new combat vehicles, design and development are checked by tests with test supports which may be classified in three groups in accordance with their main operational purposes:

component test supports are intended for checking and optimizing individual components such as the weapon control system, reconnaissance assemblies, and fire control sensors;

method test supports are intended for developing concept-specific methods such as firing methods and fire control functions, but also for checking logistic and tactical aspects;

Configuration test supports are intended for determining the optimal configuration including the geometrical aspects of the components and methods.

In this connection procedures, systems and components are improved by iterative optimization, and interaction must be established between the optimization cycles for matching components, systems and methods with each other.

Such an optimization process starts with requirements which cannot be satisfied any longer by existing systems. To satisfy such requirements, ideas for a new concept are developed which can be classified in three groups: "methods", "components" and "configurations". The new concept is first tested for components and methods by performing interactive testing and optimizing cycles. As soon as a satisfactory degree of optimization has been achieved, the configuration including the construction of a configuration test support may be commenced. In this respect, however, there arises a problem: with the requirement of realistic test conditions the configuration test support should be as close to the desired final system as possible, i.e. it should approach a prototype. On the other hand, such a prototype cannot readily be modified at low cost. If negative results are obtained in the course of testing, recourse must again be had to the conceptual stage in order to take fundamental remedial action. Therefore, in conventional development procedures there exists the difficulty that any conceptual modification will become more difficult and more expensive as the concept becomes progressively more precise.

It is the object of the present invention to provide a test support of the above-specified kind which can readily be adapted to different configuration methods and permits interactive component optimization at little expense.

For solving the above-specified object it is provided in accordance with the invention that a combat space container can interchangeably be mounted in said opening, said combat space container carrying components and/or equipment to be tested, that the combat space container comprises a cage which is detachably joined to the undercarriage and covered by a roof detachably joined thereto, that the cage accommodates largely invariant components and/or equipment, and that the roof carries components and/or equipment that are to be varied more frequently.

The test support in accordance with the invention provides the effect that any "rigidity of concept" in the advanced stage of system development is prevented. The test support according to the invention permits optimization of configurations and components under the dynamic conditions of field and combat tests while including the crew as an integral part of the system in parallel to the configuration and component optimization and not only upon complete technical maturity of concept-specific components, while it is unnecessary to construct a new test support upon each modification of discrete sensitive system parameters, components and/or equipment.

Advantageous embodiments of the invention are protected in the subclaims.

DESCRIPTION OF THE DRAWINGS

Below, an embodiment of the invention will be explained in detail with reference to schematic drawings, in which.

DESCRIPTION OF THE PREFERRED EMBODIMENTS

Figure 2:
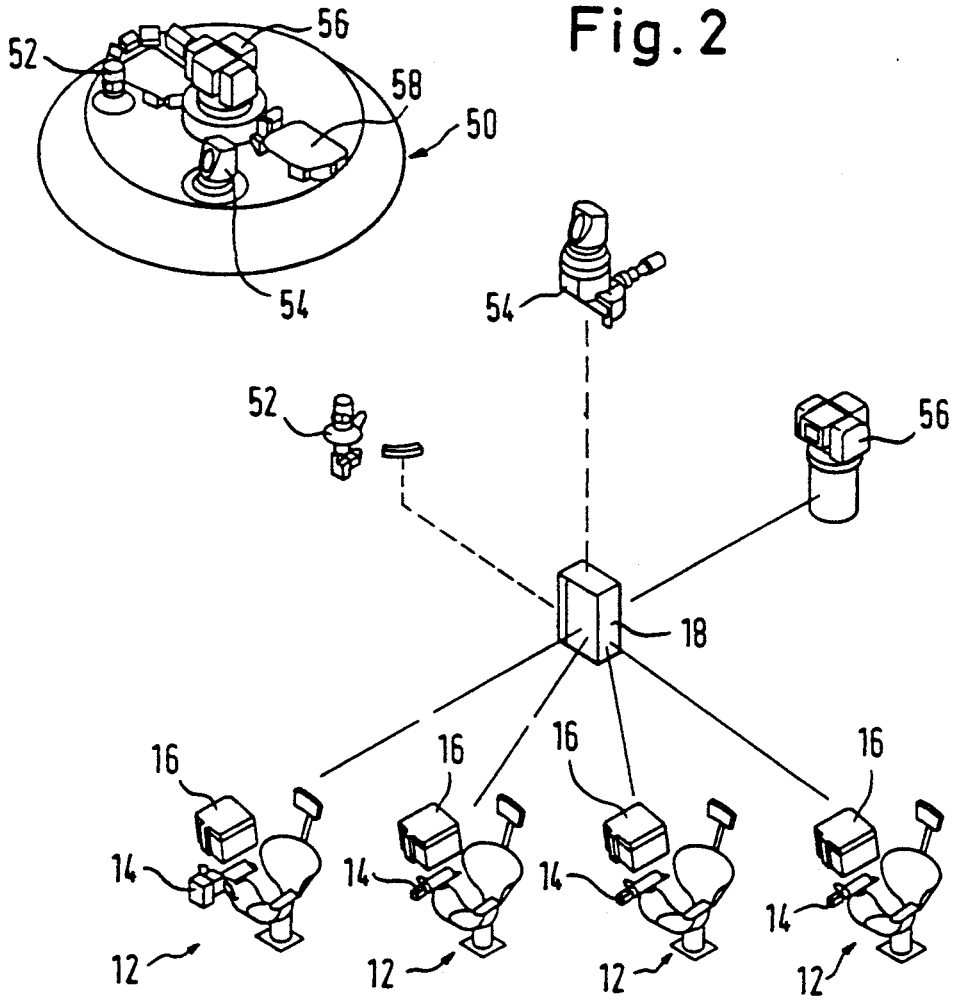
FIG. 2 is an exploded view showing the various parts of an interchangeable combat space container mounted in the test support of FIG. 1, wherein equipment is mounted on the combat space container which partly differs from that of FIG. 1.
Figure 2:
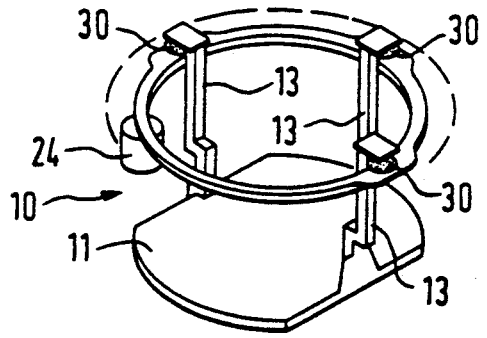

In the figures, identical parts or parts having identical effects have been given the same reference numerals.

Figure 1:
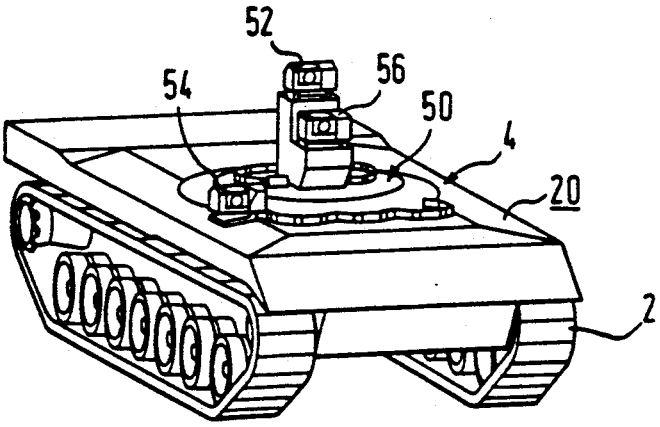
FIG. 1 is a perspective view of one example of a test support according to the invention.

FIG. 1 illustrates a test support according to the invention. An undercarriage 20 includes a chain mechanism 2 and (not illustrated). comprises a drive system and a cockpit The undercarriage 20 is provided with an opening for accommodating a combat space container 4. FIG. 1 merely shows a roof 50 of said combat space container 4, said roof carrying various equipment. Such equipment includes a weapon system simulator such as a laser-type firing simulator 56, a ranging device 54, an observation device 52 and a stabilized viewing unit 58 (U.S. Pat. No. 4,523,487).

As illustrated in FIG. 2, the combat space container 4 comprises a cage 10 adapted to be mounted in the opening of the undercarriage 20 and detachably joined thereto, as explained in detail with reference to FIG. 3. The cage 10 contains combat stations 12 (a total of four combat stations in the illustrated embodiment) each having a control handle 14 and a monitor 16 associated therewith. Moreover, a central electronic unit 18 is accommodated in the cage 10. The cage 10 itself has a bottom 11 which is supported via vertical braces 13 and shock absorbers 30 on a back-up ring 32 forming part of the cage 10. In the illustrated embodiment, three braces 13 are provided with a respective offset of 90° relative to each other, each having a shock absorber 30 in the form of a rubber member. Also, the cage comprises a stabilized azimuth drive means 24 through which the cage can be rotatably driven in the opening of the undercarriage 20. The devices 52 to 58 are disposed for easy replacement within the roof 50. Due to the shock-absorbing suspension, all of the components 12 to 18 and 52 to 58 arranged within the combat space container 4 are effectively protected against shocks acting on the undercarriage when the test support travels over uneven ground.

Figure 3:
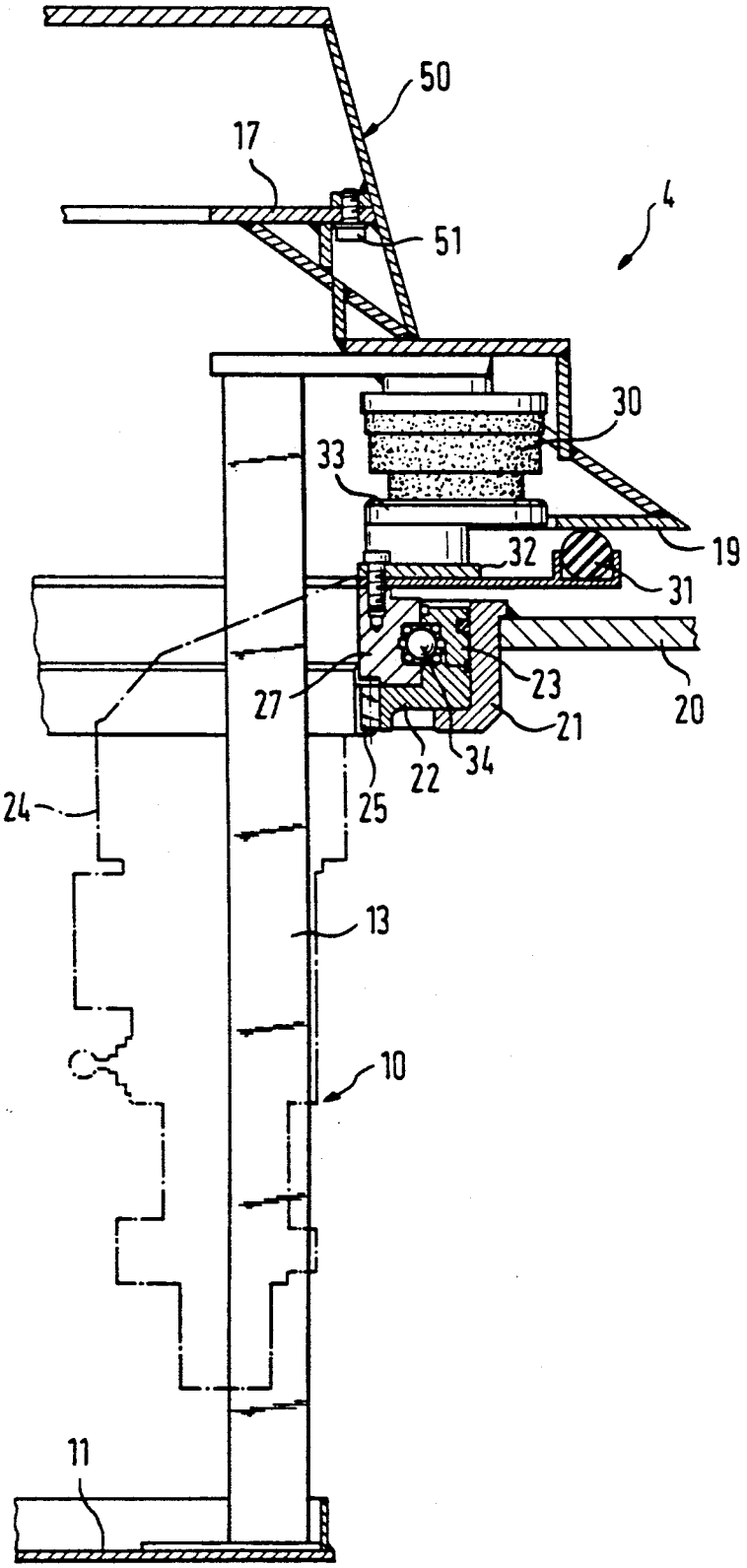
FIG. 3 is a partial sectional view through a combat space container of the invention in assembled state.

FIG. 3 illustrates in detail the structure of the combat space container 4. The inner periphery of the opening in the undercarriage 20 is surrounded by an annular flange 21 which carries a fixed bearing ring 23 in its upper portion and a fixed ring mount 22 with a ring gear 25 at its lower portion. A wire bearing 34 is disposed between the fixed bearing ring 23 and an inner bearing ring 27. A back-up ring 32 is joined to the inner bearing ring 27 and carries posts 33 which are respectively offset by 90°. The three braces 13 of the cage 10 are supported on the posts 33 via rubber members 30.

Mating gears (not illustrated) of the stabilized azimuth drive means 24 cooperate with the ring gear 25 of the ring mount 22. . Structure and operation of this azimuth drive means are known (U.S. Pat No. 4,353,446) so that a detailed description is omitted.

The upper ends of the braces 13 are joined to a supporting structure including an upper ring member 17 and a lower ring member 19.

The roof 50 is detachably joined via bolts 51 to the upper supporting ring member 17. The interior of the cage 10 is sealed against the environment by means of a sealing ring 31 which is accommodated in a groove formed on the back-up ring 32 and the upper surface of which is urged against the bottom surface of the lower ring member 19 of the supporting structure 17, 19.

It will be apparent that by loosening of the bolts 51 the roof 50 and hence the components and/or devices carried by the roof 50 may readily be removed and serviced or replaced by a roof having different components and/or devices mounted thereon. The time for testing new components and/or devices in the field is thereby shortened.

We claim:

1. A test support comprising an undercarriage with an opening formed in said undercarriage dimensioned for a turret, a combat space container (4) adapted to be interchangeably mounted in said opening and to carry components and/or devices (12 to 18; 52 to 56) to be tested, said combat space container comprising a cage (10) which is detachably joined to the undercarriage (20) and covered by a roof (50) detachably joined thereto, said cage (10) accommodating largely invariant components (12) and/or devices (18), and said roof (50) accommodating components and/or devices (52, 54, 56) that are to be varied more frequently.

2. The test support as claimed in claim 1, wherein said cage (10) carries combat stations (12) including associated instruments (14, 16) and a central electronic unit (18) and said roof (50) carries at least a weapon system simulator (56), observation and ranging devices (52, 54) and a viewing unit (58), and said cage is azimuthally mounted for rotation in the opening in said undercarriage (20).

3. The test support as claimed in claim 1, wherein said undercarriage (20) comprises a fixed ring mount (22), and said cage (10) is adapted to be rotatably driven by stabilized azimuth drive means (24) disposed on said cage (10) in cooperation with said ring mount (2).

4. The test support as claimed in claim 1, wherein said cage (10) is suspended within said undercarriage (20) by way of shock absorbers (30).

5. The test support as claimed in claim 4 wherein said cage (10) comprises a bottom (11) for accommodating at least one combat station (12) and braces (13) that are vertically supported on a rotary back-up ring (32) through shock absorbers (30) mounted at the upper ends of said braces, aid back-up ring being azimuthally supported for rotation by a bearing (34) on said undercarriage (20).

6. The test support as claimed in claim 5, wherein three said braces (13), including three said shock absorbers, are respectively engaged at a 90° offset relationship with the periphery of said back-up ring (32).

7. The test support as claimed in claim 1, wherein said roof (50) is joined through bolts (51) to a supporting member (17) of said cage (10).

8. A test support for an undercarriage with an opening therein dimensioned for a turret, the test support comprising:

a cage adapted to be interchangeably mounted in the opening in the undercarriage and to carry components to be tested, said cage being adapted to accommodate therein components to be tested and devices supporting testing of components and a roof detachably mounted on said cage, said roof being adapted to accommodate components to be tested.

* * * * *